US005416948A

United States Patent [19]

Wörwag

[11] Patent Number: 5,416,948

[45] Date of Patent: May 23, 1995

[54] VACUUM CLEANING TOOL FOR WET AND DRY VACUUM CLEANERS

[75] Inventor: Peter Wörwag, Romanshorn, Switzerland

[73] Assignee: Firma Fedag, Romanshorn, Switzerland

[21] Appl. No.: 19,473

[22] Filed: Feb. 18, 1993

[30] Foreign Application Priority Data

Feb. 18, 1992 [DE] Germany ..... 42 04 749.8

[51] Int. Cl.[6] ..... A47L 5/30

[52] U.S. Cl. ..... 15/331; 15/387; 15/416

[58] Field of Search ..... 15/387, 416, 331

[56] References Cited

U.S. PATENT DOCUMENTS

| | | | |
|---|---|---|---|
| 2,904,816 | 9/1959 | Skolfield | 15/375 |
| 2,904,817 | 9/1959 | Brennan | 15/375 |
| 4,426,751 | 1/1984 | Nordeen | 15/384 |
| 4,951,346 | 8/1990 | Salmon | 15/331 X |
| 5,008,973 | 4/1991 | Wörwag | 15/387 X |
| 5,088,149 | 2/1992 | Berg et al. | 15/387 X |
| 5,168,599 | 12/1992 | Williams | 15/387 X |
| 5,293,665 | 3/1994 | Wörwag | 15/387 |

FOREIGN PATENT DOCUMENTS 3414860 4/1984 Germany .

*Primary Examiner*—Christopher K. Moore
*Attorney, Agent, or Firm*—Robert W. Becker & Associates

[57] ABSTRACT

A vacuum cleaning tool comprising a housing having a base that is provided with at least one intake opening over which is provided a brush chamber in which is disposed a brush roller having bristles that project into the intake opening. A flow channel connects the brush chamber to a connector that can communicate with a vacuum line of a vacuum cleaning unit. A turbine chamber is disposed in the flow channel and accommodates an air turbine that can rotatably drive the brush roller. The housing also has a wet intake opening that is disposed approximately in the plane of the base of the housing. Parallel to the brush chamber and the flow channel, the housing has a wet intake channel that connects the wet intake opening to the connector. Respective controllable flow blocking devices are disposed in the wet intake channel and in the flow channel.

17 Claims, 12 Drawing Sheets

VACUUM CLEANING TOOL FOR WET AND DRY VACUUM CLEANERS

BACKGROUND OF THE INVENTION

The present invention relates to a vacuum cleaning tool.

When cleaning floor coverings, especially textile floor coverings, wet cleaning is indispensible. Initially, the coarse dust is vacuumed up; this is preferably carried out with a brush roller that rotates in the intake air stream. Thereafter, cleaning foam is applied and the floor covering is cleaned mechanically, preferably with a brush that merely rotates. Excess liquid must then be vacuumed up so that after the floor covering is dry it can again be vacuumed, possibly with brushes.

For dry vacuuming a vacuum cleaning tool such as disclosed in U.S. Pat. No. 4,426,751 is used. Such a vacuum cleaning tool has two oppositely rotating brush rollers that are disposed in a brush chamber, with respective intake air channels being tangentially disposed relative to the brush rollers. The two intake air channels open into a common connector that leads to a vacuum cleaning unit.

German Offenlegungsschrift DE 34 14 860 A1 discloses that the turbine air stream that drives the brush roller can be adjusted by a controllable flow guide.

For wet cleaning, especially for vacuuming up any excess cleaning fluid, a suitably adapted vacuum cleaning tool must be used. The vacuum cleaning tool must be changed for the respective procedure. This is laborious and time consuming, especially when only parts of a larger surface can be cleaned one after the other.

It is therefore an object of the present invention to improve a vacuum cleaning tool of the aforementioned general type in such a way that both dry and wet vacuuming procedures can be carried out without having to change the vacuum cleaning tool.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
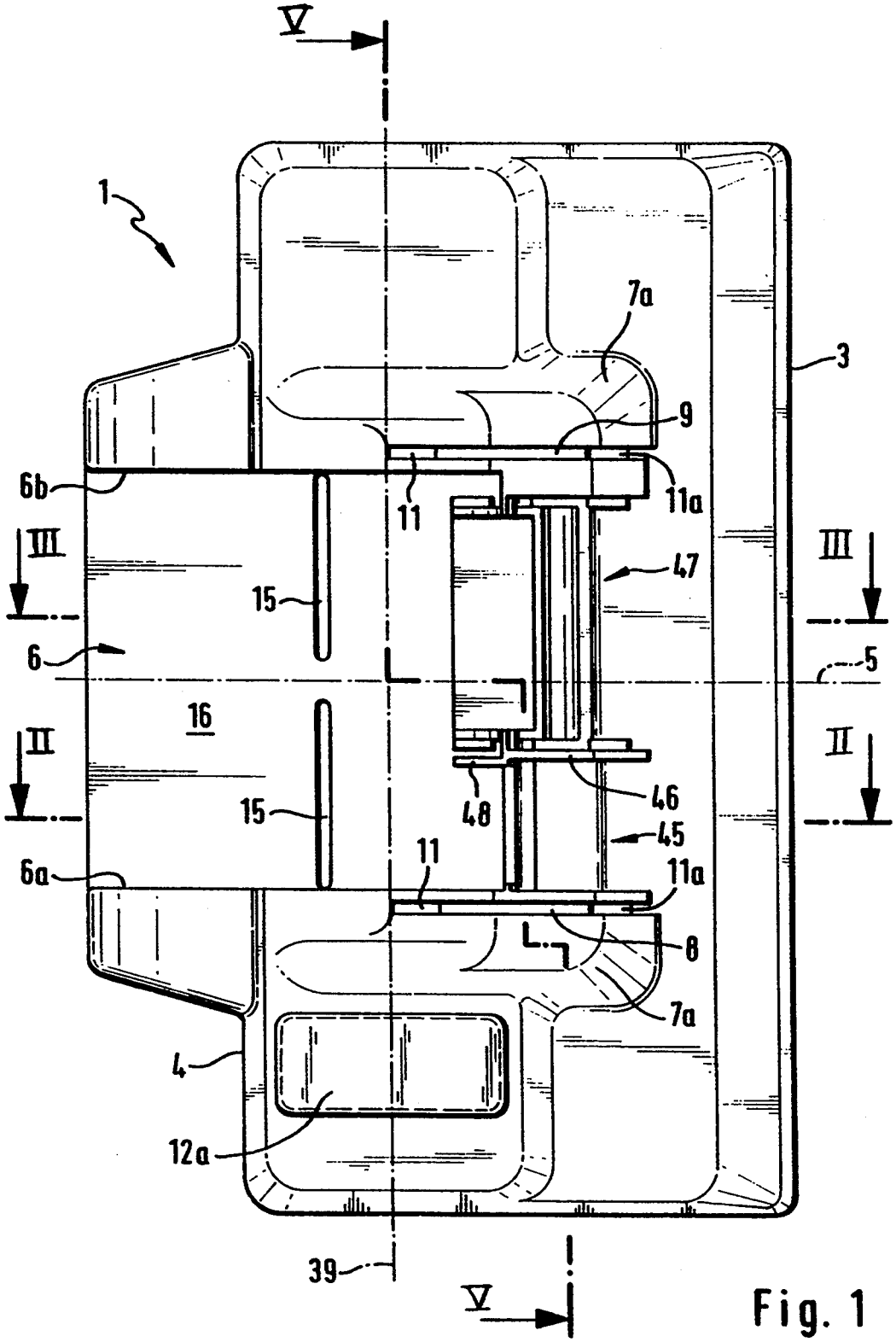
FIG. 1 is a top view of the upper portion of the housing of one exemplary embodiment of the inventive vacuum cleaning tool.

The vacuum cleaning tool of the present invention comprises: a housing having a base that is provided with at least one intake opening, the housing also having connector means for communicating with a vacuum line of a vacuum cleaning unit, wherein over the at least one intake opening there is provided in the housing a brush chamber in which is disposed a brush roller having bristles that project into the intake opening, the housing furthermore having a flow channel that connects the brush chamber to the connector means for an intake air stream, with a turbine chamber being disposed in the flow channel and accommodating an air turbine that is adapted to rotatably drive the brush roller, the housing also having a wet intake opening that is disposed approximately in a plane of the base of the housing, and the housing additionally being provided, parallel to the brush chamber and the flow channel, with a wet intake channel that connects the wet intake opening to the connector means; and respective controllable flow blocking means disposed in the wet intake channel and in the flow channel.

The wet intake channel, which is formed in particular between the upper portion of the housing and a cover part that can be secured to the housing, connects a wet intake opening provided in the plane of the housing base to the connector means of the vacuum cleaning tool, so that the intake opening, the brush chamber, and the flow channel to the connector means, and hence also the turbine chamber, are bypassed. There is thus provided a separate flow path for wet vacuuming procedures, thereby avoiding any adverse effects upon the flow paths for dry vacuuming. A flow blocking means is provided in the wet intake channel as well as in the flow channel, so that one or the other channel can be alternatively operated. The flow blocking means completely closes off the channel that is not required, so that no unwanted flow, whether wet or dry, occurs.

Advantageously, an auxiliary air channel that opens into the turbine chamber is provided parallel to the flow channel, with this auxiliary air channel being provided with a controllable flow blocking means so that in the dry mode either a flow of intake air with the brush rotating is available or just a rotating brush itself. A vacuum cleaning tool embodied in such a manner can be used in three entirely independent operating modes, namely brushing with an intake air stream (flow channel open), brushing without intake air stream (auxiliary air channel open), and wet vacuuming (wet intake channel open).

To ensure that when one of the channels is open the other channels are closed, the flow blocking means are interconnected in relative positions by a link member. Advantageously, such a link member has a control cam that is engaged by the free end of a control arm of the pertaining flow blocking means, which is designed as a flap. The cams are designed and physically arranged in conformity with the desired control positions.

The cover, which together with the upper portion of the housing forms the wet intake channel, can advantageously be clamped or clipped to the housing of the vacuum cleaning tool. In this way, the cover can be easily replaced by a cover plate that merely covers the transfer opening of the auxiliary air channel and the transfer opening of the wet intake channel that opens out at the upper portion of the housing.

Further specific features of the present invention will be described in detail subsequently.

DESCRIPTION OF PREFERRED EMBODIMENTS

Figure 6:
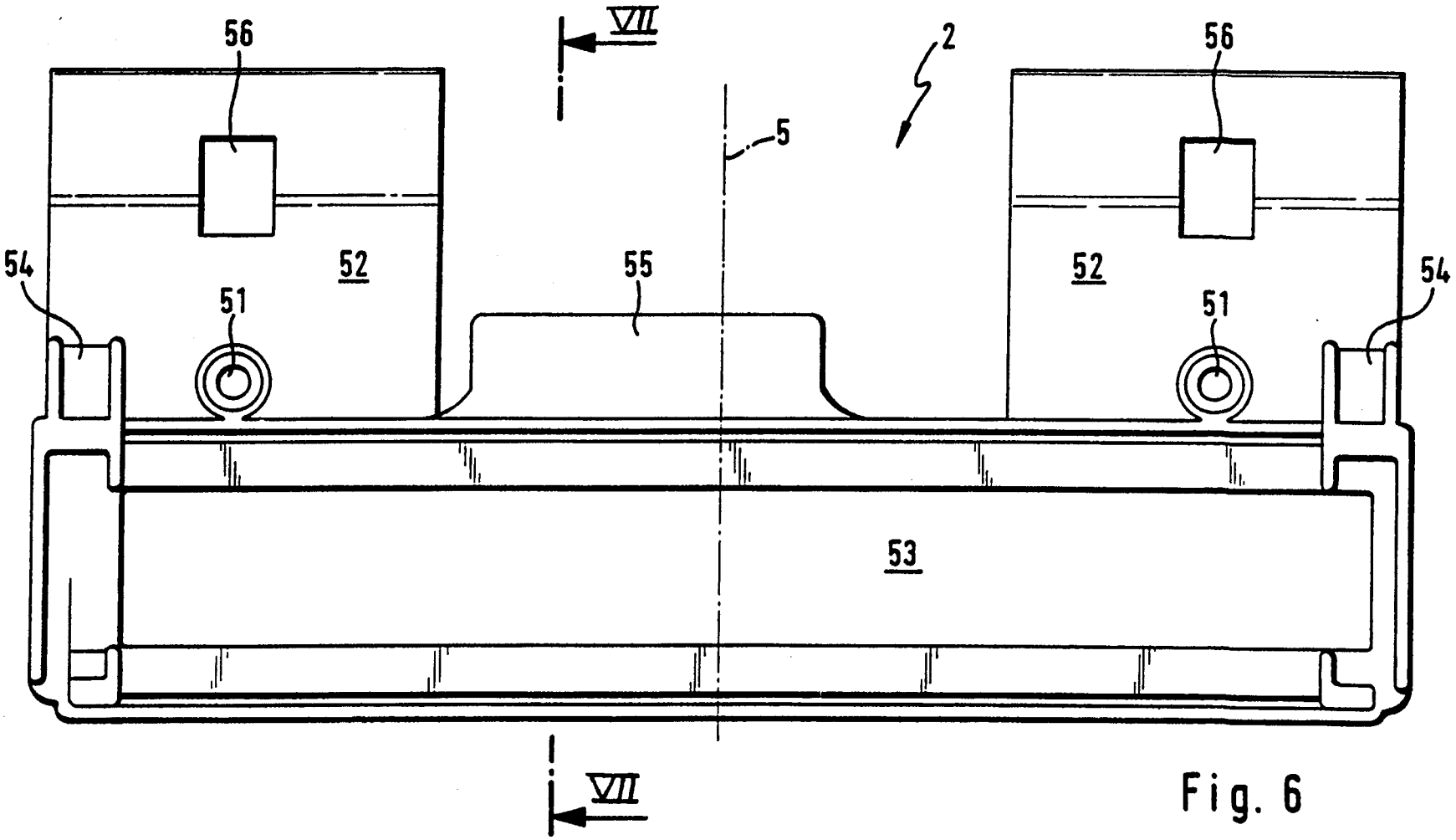
FIG. 6 is a plan view of the underside of the bottom portion of the housing of the vacuum cleaning tool.
Figure 10:
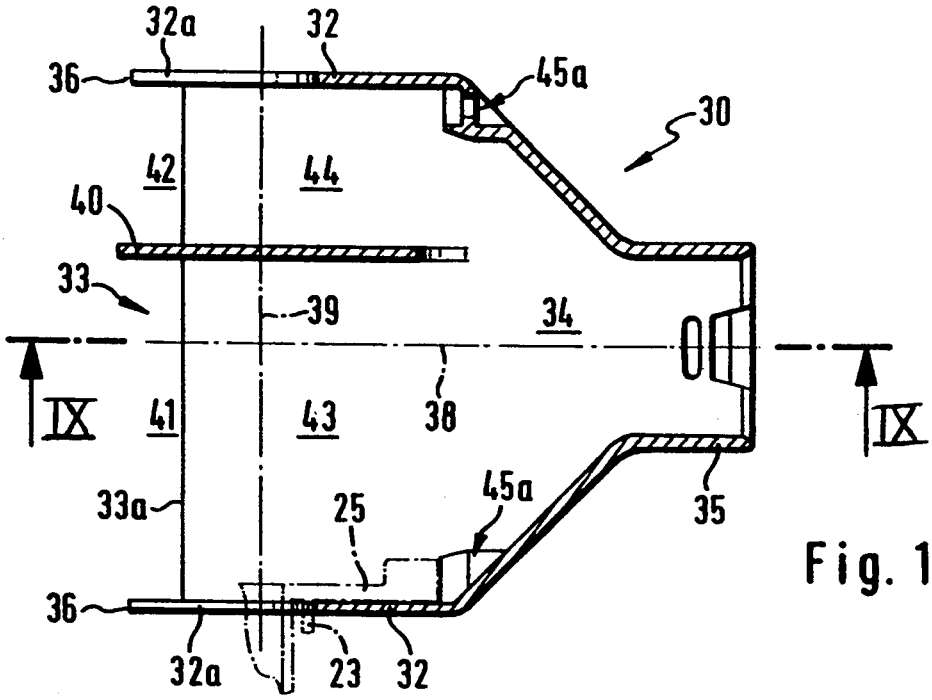
FIG. 10 is an axial cross-sectional view through the turbine casing of FIG. 8.
Figure 9:
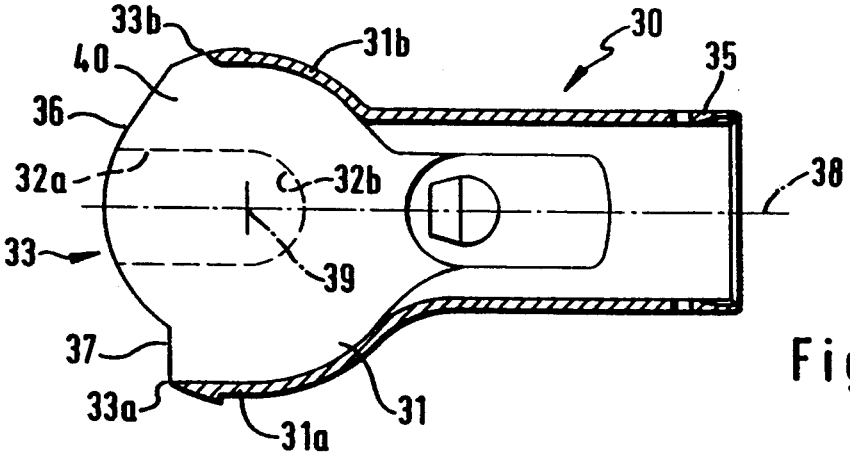
FIG. 9 is a cross-sectional view taken through the turbine chamber casing along the line IX—IX in FIG. 10.
Figure 8:
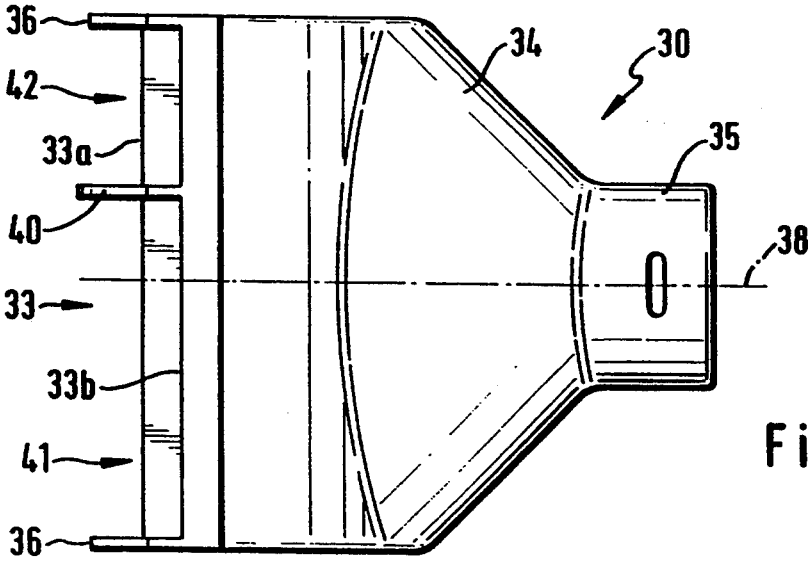
FIG. 8 is a top view of a turbine chamber casing with an integral connector.

Referring now to the drawings in detail, the illustrated vacuum cleaning tool has a housing that is composed of an upper portion 1 (FIG. 1) and a preferably hinged bottom portion 2 (FIG. 6). As can be seen from the plan view of FIG. 1, the upper portion 1 of the housing is essentially rectangular, with one long side forming the front face 3 of the vacuum cleaning tool and the other long side forming the rear 4 of the tool. A mounting or receiving means 6 is provided in the upper portion 1 of the housing; the receiving means 6 extends symmetrically relative to the transverse central axis 5 and is essentially open upwardly as well as toward the rear 4 of the vacuum cleaning tool. The receiving means 6 serves for the installation of a turbine chamber casing 30, as shown in FIGS. 8 to 10. The casing 30 essentially comprises a semi-cylinder 31 that is closed off at its axial ends by walls 32. On the side opposite the opening 33, the semi-cylinder 31 is connected to a funnel portion 34 that merges with a connector 35 for a vacuum hose of a non-illustrated vacuum cleaning unit. That edge 36 of the side walls 32 of the turbine chamber casing 30 that faces the opening 33 is rounded, with a step 37 being provided at the transition to the base portion 31*a* of the semi-cylinder 31. This step 37 cooperates with a stop or abutment 79 of the housing (FIG. 11) to limit the pivoting movement of the turbine chamber casing 30 in the receiving means 6. Disposed in each side wall 32 is a slot 32*a* that extends in the direction of the longitudinal axis 38 and ends in a semi-circle 32*b* (FIG. 9). The center point of the semi-circle 32*b* lies on the central axis 39 of the semi-cylinder 31, which at the same time represents the axis of rotation of the turbine chamber casing 30 in the upper portion 1 of the housing, and also represents the axis of rotation of an air turbine that is disposed in the turbine chamber casing.

When viewed from above, the front long edge 33*a* of the base portion 31*a* of the semi-cylinder is disposed ahead of the long edge 33*b* of the cylinder portion 31*b* that forms the top. The opening 33, which is delimited by the long edges 33*a* and 33*b* as well as by the edges 36 of the side walls 32, has a height that is approximately equal to the diameter of the semi-cylinder 31 and is divided into a large inlet opening 41 and a small inlet opening 42 by a partition 40 that extends perpendicular to the central axis 39. The large inlet opening 41 opens into the actual turbine chamber 43, which is delimited by one of the axial side walls 32 and a partition 40. The small inlet opening 42 forms a bypass channel 44 for the turbine chamber 43 for a reason to be discussed in detail subsequently.

Provided in the region where the funnel portion 34 is connected to the axial sidewalls 32 are mounting means 45*a* for non-illustrated securing screws or bolts.

The turbine chamber casing 30 is mounted in such a way in the receiving means 6 that it is pivotable about the axis 39. Channels formed in the upper portion 1 of the housing are associated with the turbine chamber casing 30. As can be seen in FIG. 1, the opening 42 of the turbine chamber casing 30 that is installed in the receiving means 6 is disposed across from a transfer channel 45, which is separated from a further transfer channel 47 by a partition 46. As can be seen in particular from FIGS. 2 and 3, the transfer channels 45 and 47 are disposed on the upper part of the housing facing the front face 3. An extension 48 (FIG. 1) of the partition 46 extends into the semi-cylindrical receiving means 6 so that when viewed in the axial direction, the extension 48 is aligned with the partition 40 when the turbine chamber casing 30 is installed.

Figure 3:
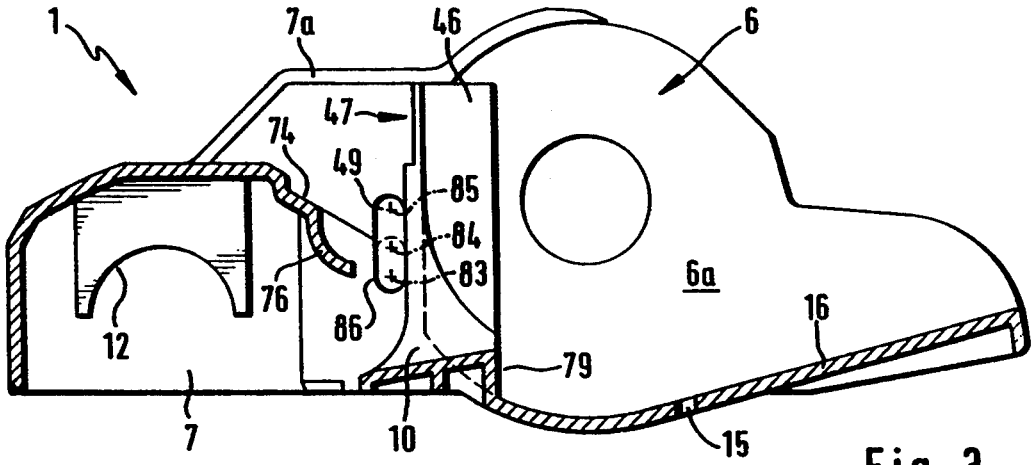
FIG. 3 is a cross-sectional view taken along the line III—III in FIG. 1.
Figure 5:
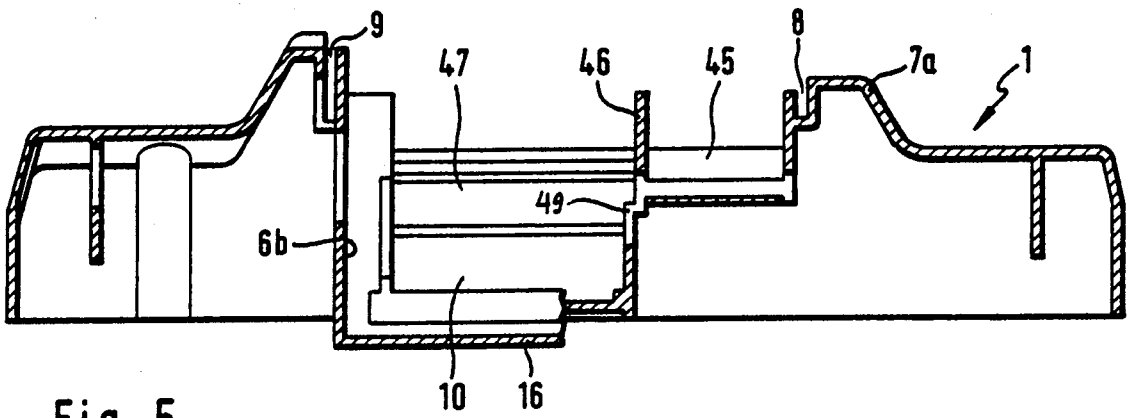
FIG. 5 is a cross-sectional view taken along the line V—V in FIG. 1.

Provided below the transfer channel 47 is a flow channel 10 (FIG. 3) that starts at the brush chamber 7 and opens into the receiving means 6. As shown in FIG. 3, provided in the partition 46 is a vertical slot 49 that begins above the flow channel 10 and extends approximately to the bottom edge of the transfer channel 45 (see also FIG. 5). The slot 49 serves for receiving control shafts 83, 84, 85 of flow blocking means 80, 81, 82 (FIG. 11), which will be described in detail subsequently.

Parallel to the walls 6*a* and 6*b* of the receiving means 6, the housing structure 7*a*, which is provided with the receiving means 6, has grooves 8 and 9 that extend parallel to the transverse central axis 5. Arresting openings 11 and 11*a* are provided in the bases of these grooves. The housing structure 7*a* is symmetrical to the transverse central axis 5.

Longitudinal slots 15 are provided in the base 16 of the receiving means 6, with the base 16 being inclined at an angle of approximately 15° to the horizontal. The longitudinal slots 15 are disposed adjacent to the axis of rotation 39 on both sides of the transverse central axis 5.

On one side of the transverse central axis 5 an opening is disposed next to the housing structure 7*a*; an essentially rectangular rocker-type switch or switching means 12*a* is disposed in this opening. The switch or actuator 12*a* is pivotable about the axis 39 and has three positions, which will be described in detail subsequently.

Figure 4:
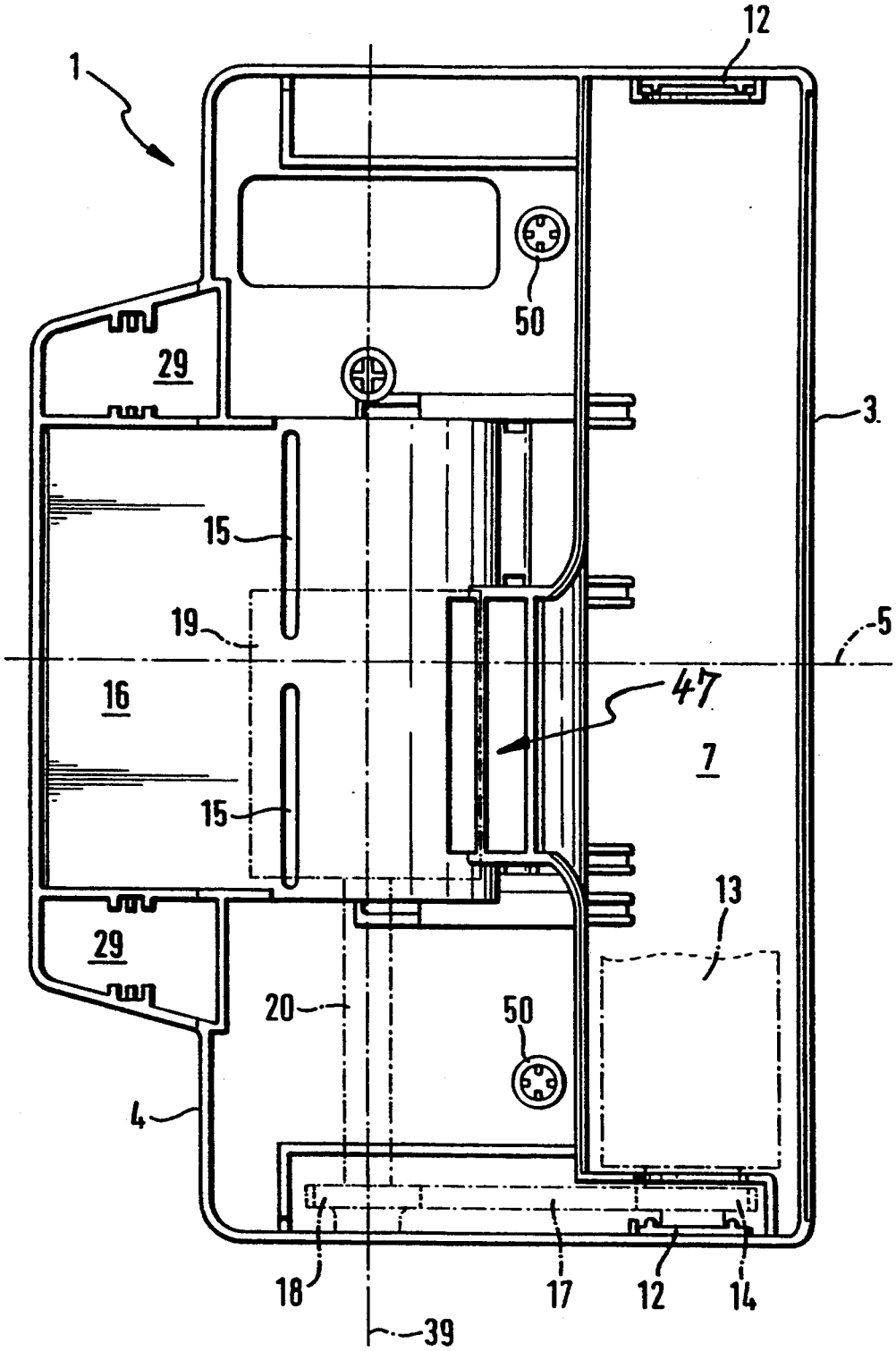
FIG. 4 is a view from below of the upper portion of the housing of FIG. 1.
Figure 22:
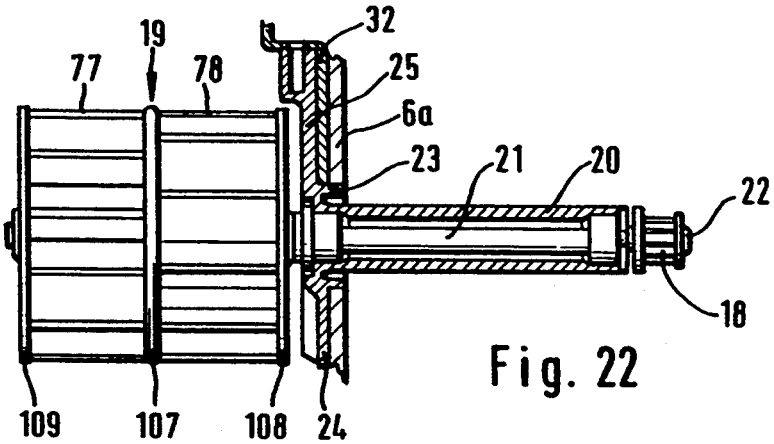
FIG. 22 is a view of an air turbine with mounting means on one side.

The bottom view illustrated in FIG. 4 shows the brush chamber 7, the axial ends of which are provided with mounting means 12 for rotatably supporting a brush roller 13. One axial end of the brush roller 13 is provided with a belt pulley 14 that is driven by a belt, preferably a toothed belt 17, by a drive pulley 18. The drive pulley 18 rotates about the central axis 39 and is driven by a drive shaft 21 (FIG. 22) of an air turbine 19, which at one axial end is mounted via the drive shaft in a hollow shaft 20 that is held in the housing. The axis of rotation of the air turbine 19 corresponds to the central axis 39.

The base 16 of the upper portion 1 of the housing projects beyond the rear 4. As can be seen from FIG. 4, disposed in the corners between the base 16 and the rear 4 are respective wheel housings 29 for the rotatable mounting of non-illustrated wheels.

Figure 7:
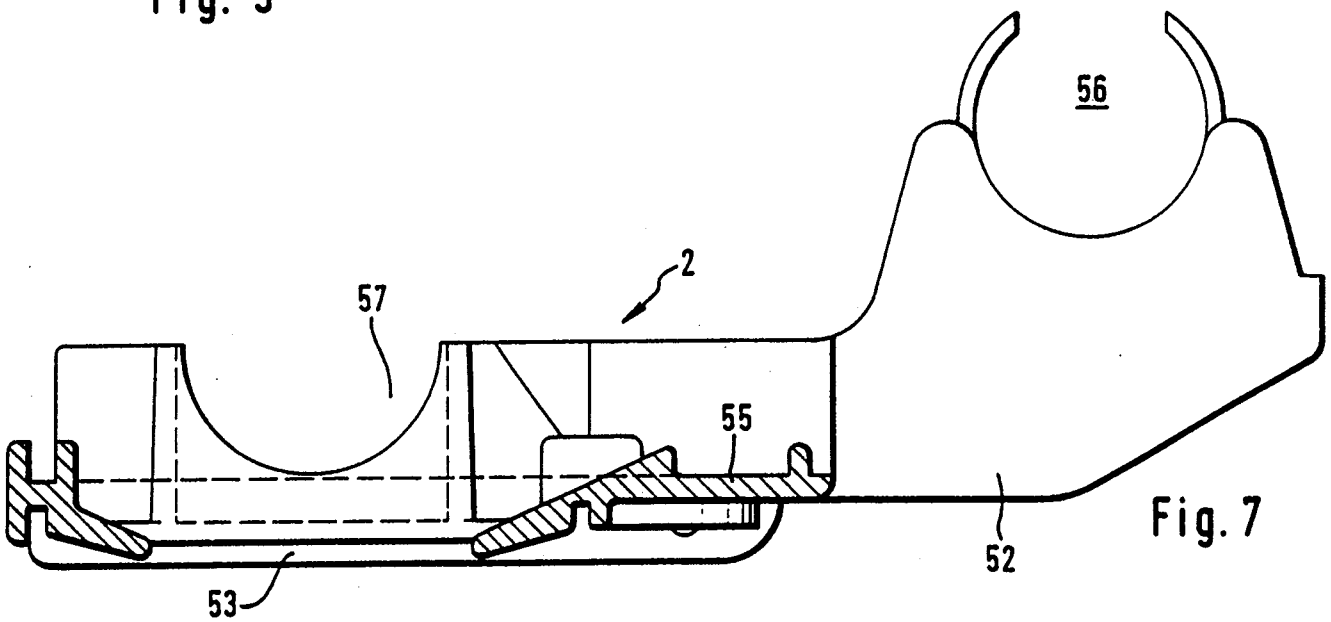
FIG. 7 is a cross-sectional view taken along the line VII—VII in FIG. 6.
Figure 11:
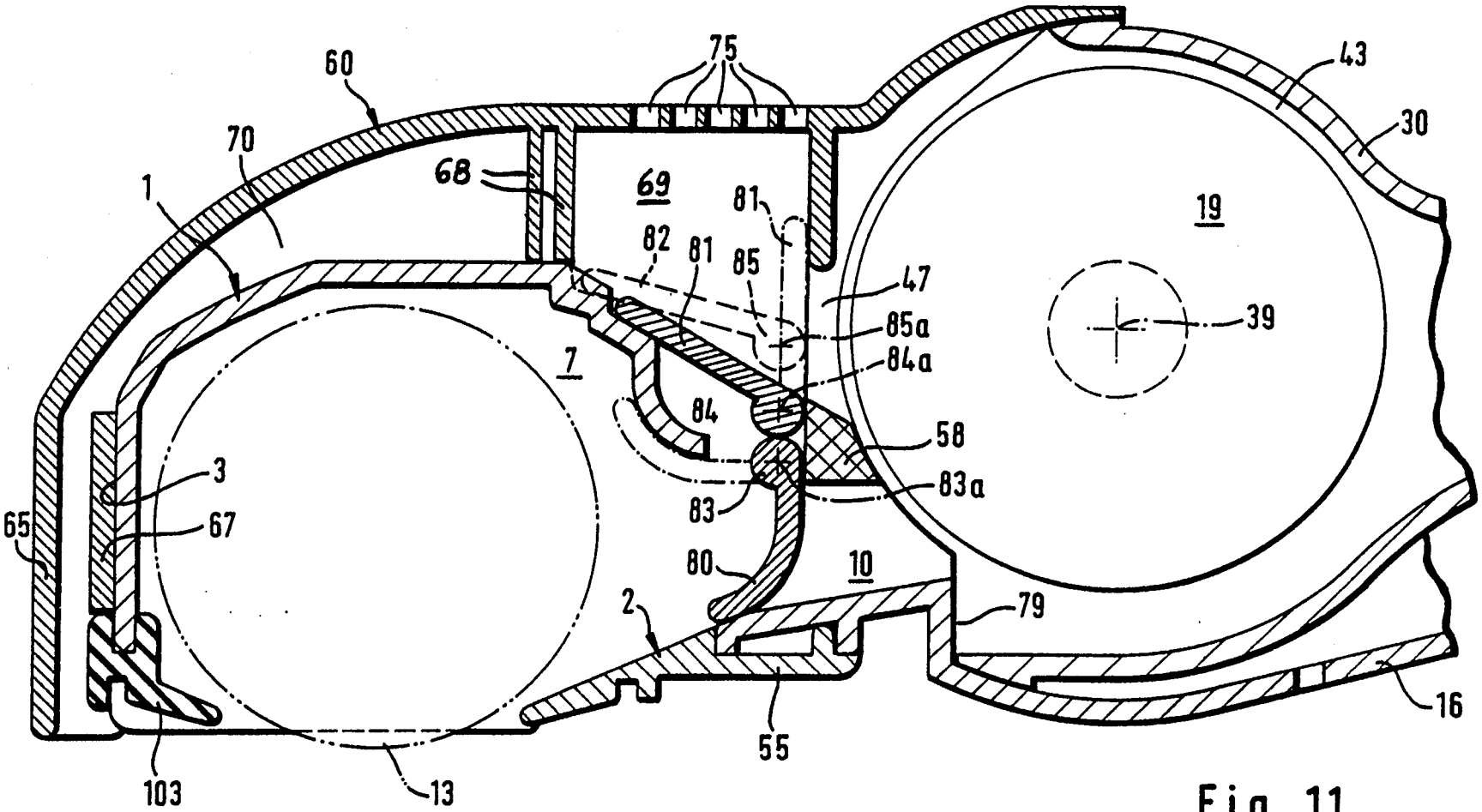
FIG. 11 is a cross-sectional view through the vacuum cleaning tool at the level of the flow channel.
Figure 12:
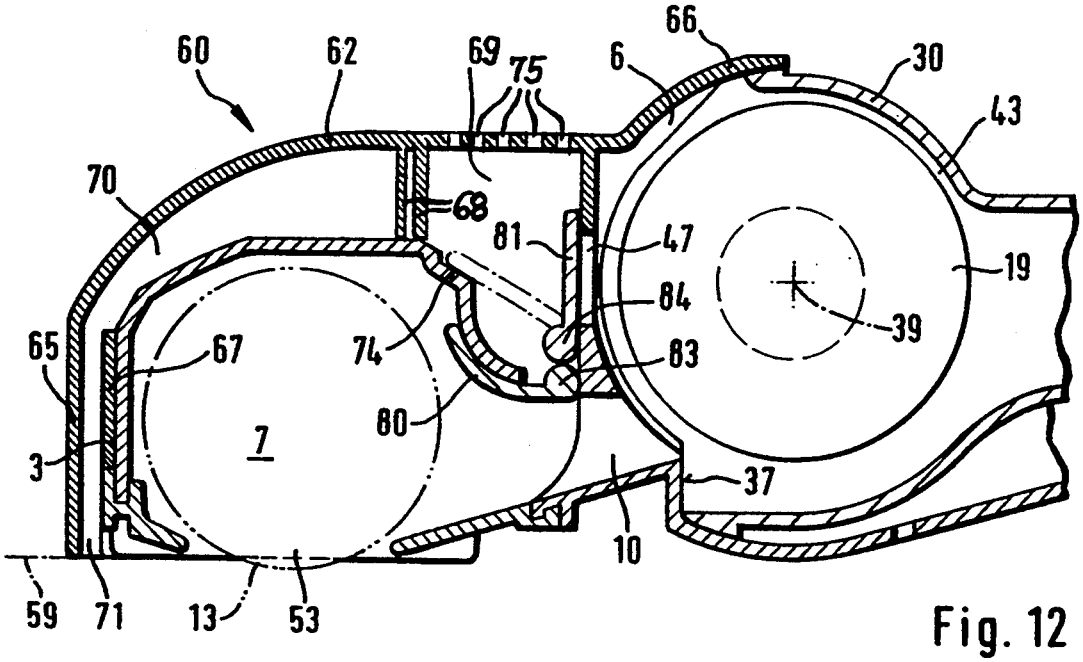
FIG. 12 is a further cross-sectional view through the vacuum cleaning tool at the level of the flow channel.
Figure 13:
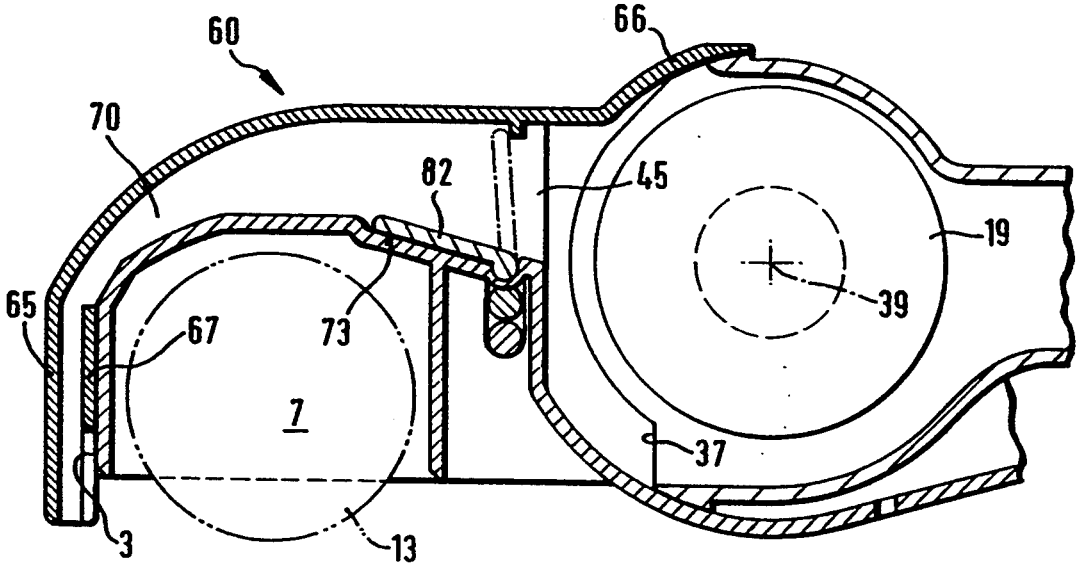
FIG. 13 is a cross-sectional view through the vacuum cleaning tool at the level of the wet intake channel.

The bottom portion 2 of the housing shown in FIGS. 6 and 7 is secured to the upper portion 1 of the housing via screw domes 50 (FIG. 4) into which are introduced fastening screws or similar securing means that pass through openings 51 provided in the bottom portion 2 of the housing. When viewed from above, the bottom portion 2 of the housing is essentially U-shaped, with the two legs 52 covering the upper portion of the housing laterally of the base 16. A suction or intake opening 53 is formed in the bottom portion 2 of the housing, which forms the base; this opening extends at right angles to the transverse central axis 5 and essentially over the entire width of the vacuum cleaning tool. As schematically illustrated in FIGS. 11 to 13, the bristles of the brush roller 13 project through the intake opening 53. A respective U-shaped mounting means 54 is provided at each of the narrow sides of the lower portion 2 of the housing approximately at the level of the connection of the legs 52; these mounting means serve for the rotatable mounting of further non-illustrated rollers that support the vacuum cleaning tool on the ground. Disposed between the two legs 52 is an extension 55 that, as shown in FIG. 11, extends below the flow channel 10. This ensures a tight connection between the bottom portion 2 and the upper portion 1 of the housing in the region of the flow channel 10. It can also be advantageous to dispose a profiled rubber strip 103 (FIG. 11) between the bottom edge of the front face 3 of the upper portion 1 of the housing and the edge of the bottom portion 2 of the housing. For sealing purposes, the cross-sectional configuration of the edge of the housing should expediently be designed to fit the rubber strip 103.

As can be seen from the cross-sectional view of FIG. 7, on the side facing the bottom portion 2 of the housing the legs 52 are provided with clamping means 56 that, as will be described in detail subsequently, on both sides of the receiving means 6 fit around the shafts 20 that are mounted in the upper portion 1 of the housing and are thereby securely clamped thereto. The clamping means 56 are indicated in FIG. 6. Formed at the axial ends of the lower portion 2 of the housing are mounting covers 57 (FIG. 7) that close off the mounting means 12 of the upper portion 1 of the housing.

Figure 21:
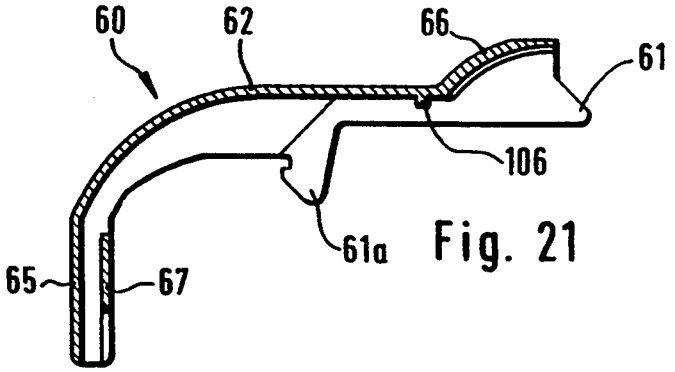
FIG. 21 is a cross-sectional view taken along the line XXI—XXI in FIG. 17.
Figure 23:
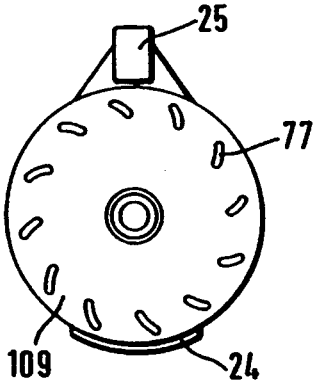
FIG. 23 is an axial cross-sectional view of the air turbine of FIG. 22.
Figure 17:
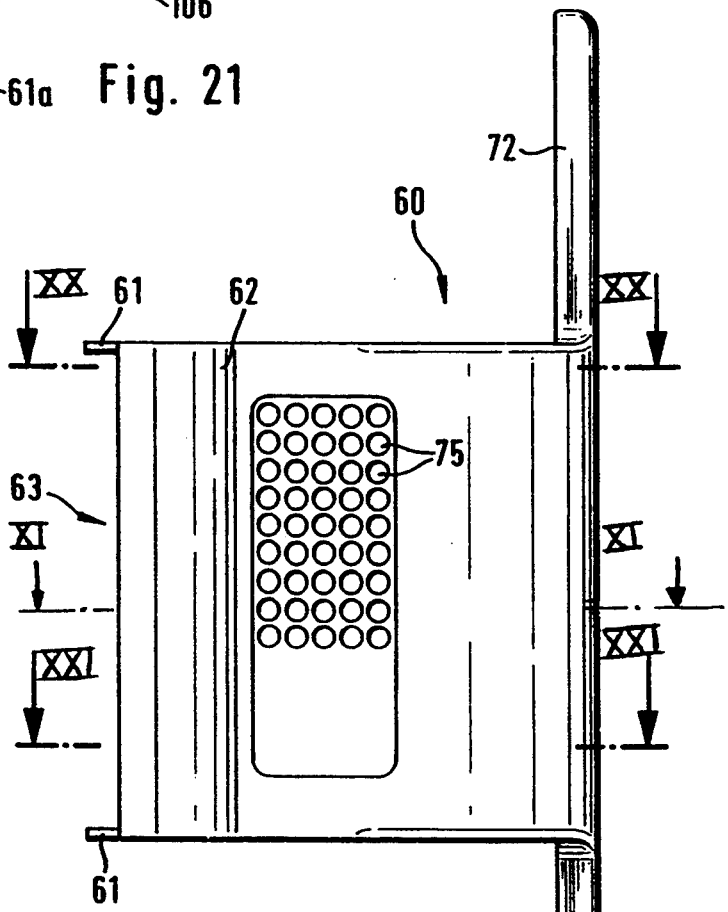
FIG. 17 is a top view of a cover for forming the wet intake channel.
Figure 20:
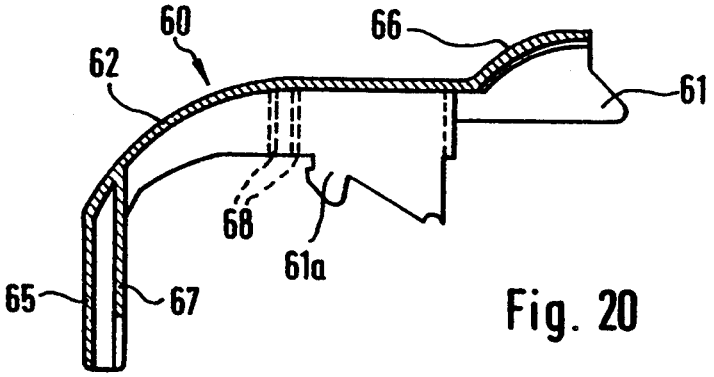
FIG. 20 is a cross-sectional view through the cover taken along the line XX—XX in FIG. 17.
Figure 18:
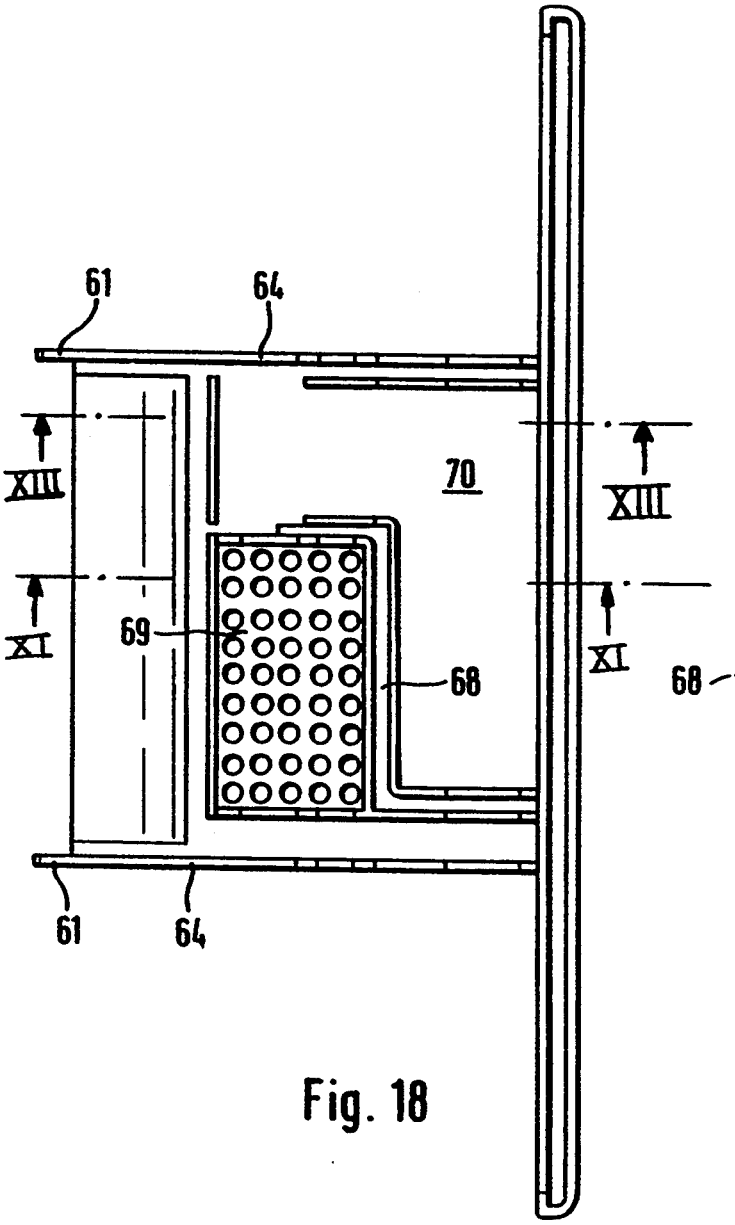
FIG. 18 is a view of the cover from below.

FIGS. 11–13 show various cross-sectional views through the inventive vacuum cleaning tool in a direction parallel to the transverse central axis 5. Secured to the upper portion 1 of the housing is a hood-like cover 60 which, as can be seen from the plan views of FIGS. 17 and 18, is approximately T-shaped. As shown in FIGS. 20 and 21, the foot of the T is angled off.

The hood-like cover 60 has a connecting portion 62, the width of which is slightly greater than the receiving means 6. The free end 63 (FIG. 17) is provided at the sides with lugs or latches 61 that are designed as extensions of the side walls 64. These side walls are designed to fit in the grooves 8 and 9 of the upper portion 1 of the housing (FIG. 1), with the forward latches 61 extending into the arresting openings 11 that are adjacent to the central axis 39. As shown in FIGS. 20 and 21, the side walls are provided with further lugs or latches **61*a* that are designed to extend into the arresting openings 11*a* (FIG. 1). Thus, the hood-like connecting portion 62 rests firmly upon the upper portion 1 of the housing and delimits or defines therewith a wet suction or intake channel 70 that extends from the receiving means 6 to the front face 3. The channel 70 connects an opening 71, which is disposed at the level 59 of the intake opening 53 in front of the front face 3, with the transfer channel 45 that leads to the receiving means 6. The opening 71 is delimited by the bottom edge of the front face 3 and, at the level 59 of the intake opening 53, by the bottom edge of a vertical wall 65 that merges into the connecting portion 62. That end of the portion 62 remote from the wall 65 has a roof or top part 66 that extends over the receiving means 6 and, when viewed from the top, ends just in front of the common axis of rotation 39**.

Figure 19:
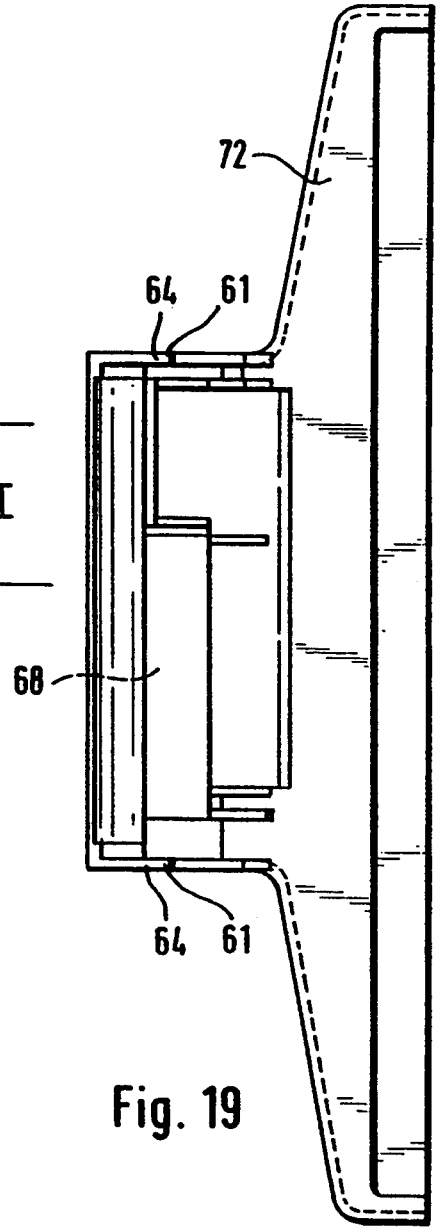
FIG. 19 is a view of the cover from the rear.

Connected to the opening 71 is a funnel portion 72 (FIG. 19) that is formed between an inner wall 67 and the outer wall 65. As part of the intake channel 70, the funnel portion 72 reduces the cross-section available for flow to the passage of the connecting portion 62, which corresponds approximately to the width of the receiving means 6. As can be seen from the bottom view of FIG. 18, disposed in the connecting portion 62, approximately perpendicular to the transverse central axis 5, is a Z-shaped sealing wall 68 that is designed as a double wall to accommodate a rubber seal. The sealing wall 68 rests against the upper portion 1 of the housing, thereby producing a region 69 that is separate from the wet intake channel 70 and is associated with the transfer opening or channel 47. As shown in FIG. 17, a plurality of openings 75 for auxiliary air are provided in the region 69 in the roof of the connecting portion 62 to allow ambient air to enter when the transfer channel 47 is open.

As can be seen in FIGS. 11 to 13, a flow blocking means is disposed in the flow channel 10 that leads from the brush chamber 7 to the turbine chamber 43. In the illustrated embodiment, the flow blocking means is in the form of a flap or similar closure means 80. In a similar manner, a flow blocking means in the form of a flap 81 is associated with the transfer opening or channel 47. Similarly, the transfer opening or channel 45 (FIG. 13) can be closed off by a flow blocking means in the form of a flap 82. Each of the flow blocking means, which are preferably in the form of flaps 80 to 82, is fixedly connected to a control shaft 83 to 85 that is held in the upper portion of the housing parallel to the central axis or axis of rotation 39. The three control shafts 83, 84 and 85 are accommodated relatively tightly in the slot 86 in the partition 46. Due to the closeness of the control shafts 83 and 84, a sort of partition is formed that separates the transfer opening 47 (FIG. 11) from the flow channel 10. The cross-hatched part 58 of the housing illustrated in FIG. 11 can advantageously therefore be dispensed with, since its separating function is taken over by the two adjacent control shafts 83 and 84.

Figure 15:
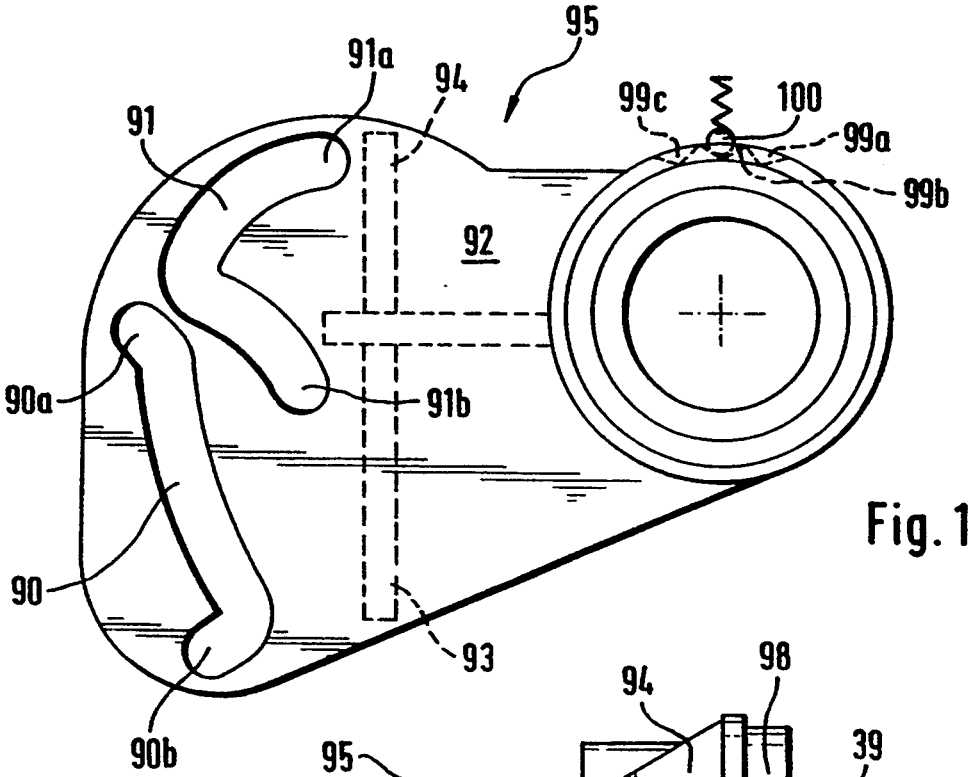
FIG. 15 shows the configuration of the link member of FIG. 14.

The ends of the control shafts 83–85 that face the rocker-type switch **12*a* are each provided with a control arm 87, 88 and 89, the free ends 87*a*, 88*a* and 89*a* of which engage control cams 90 and 91. In this connection, the free ends 87*a* and 88*a* of the control arms 87** and 88 extend into a common, U-shaped control cam 90, while the free end 89*a* of the control arm 89 extends into a separate, V-shaped control cam 91. The control cams 90 and 91 are provided in a cam plate 92 that is pivotable about the axis of rotation 39. The opening of the V of the V-shaped control cam 91 faces the axis of rotation 39; the opening of the U of the U-shaped control cam 90 faces away from the axis of rotation 39. The cam plate 92, which is illustrated as a component in FIG. 15, links the settings of the flaps 80 to 82 in conformity with the shape of the control cams 90 and 91; the cam plate 92 thus forms a link member for the flaps 80 to 82.

Figure 16:
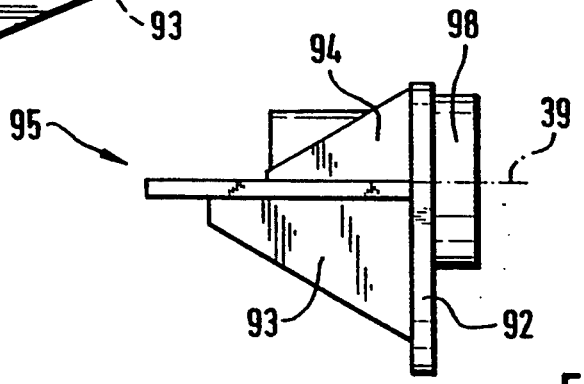
FIG. 16 is a side view of the link member of FIG. 15.

As shown in FIG. 16, the cam plate 92 is reinforced by ribs 93 and 94 so that the rocker-type switch 12*a*, which protrudes out of the upper portion of the housing, can be fixedly secured to the link member 95. By actuating the rocker-type switch 12*a*, for example with a foot, the cam plate 92 is pivoted out of the mid-position shown in FIG. 14 either in the direction of the arrow 96 or in the direction of the arrow 97.

Figure 14:
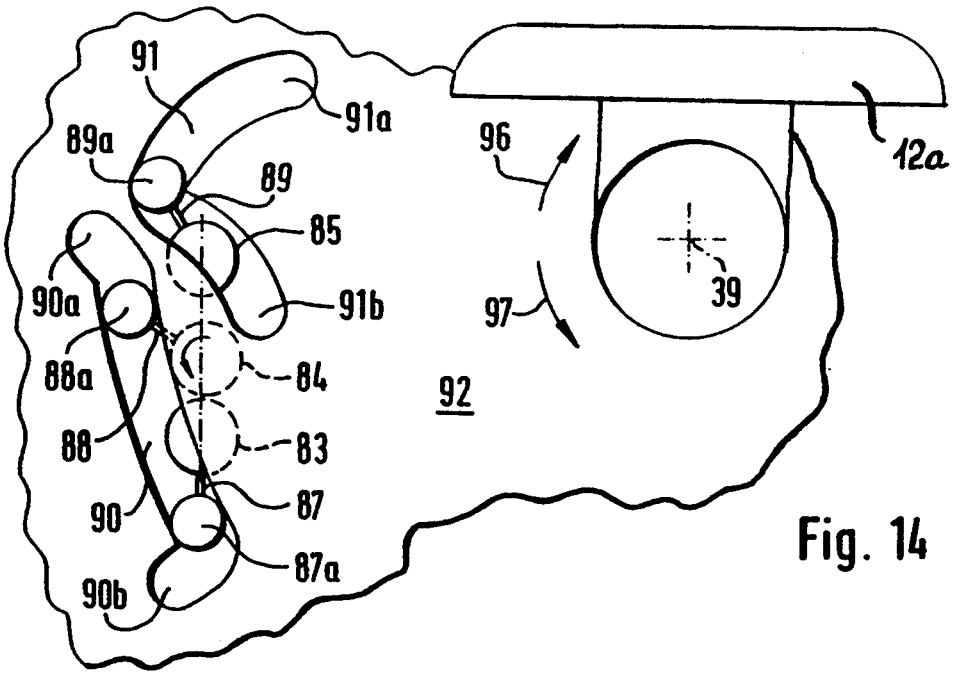
FIG. 14 schematically illustrates a link member that is designed as a switching or control means.

The arrangement is such that when the rocker-type switch 12*a* is in the mid-position, the cam plate 92 assumes the position shown in FIG. 14 in which the free end 89*a* of the control arm 89 is in the neutral low point of the V-shaped control cam 91, and the free ends 87*a* and 88*a* of the control arms 87 and 88 are disposed in the neutral region of the cross-piece of the U-shaped control cam 90. While in the neutral point of the control cam 91, the flap 82 assumes the rest position shown in FIG. 13 in which the transfer opening 45 is clear, the flaps 80 and 81 (FIG. 11) being in their operating positions in which the flow channel 10 and transfer opening 47 are closed. To compensate for measurement tolerances in the closed position, the outer end of the flap 80 can be bent in the shape of a quarter of a circle.

Figure 2:
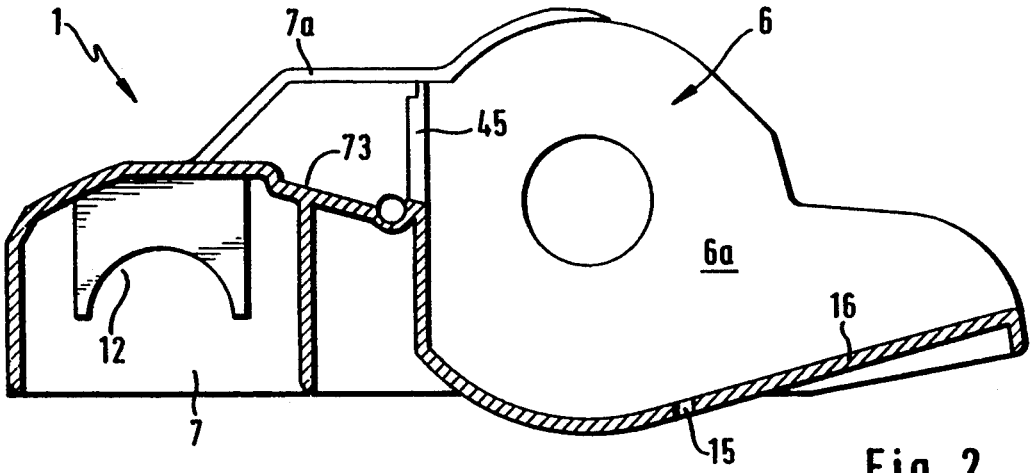
FIG. 2 is a cross-sectional view taken along the line II—II in FIG. 1.

When the flap 82 of the wet intake channel 70 is in the illustrated rest position it lies in a recess 73 in the upper portion 1 of the housing, so that the open flap 82 does not restrict flow. The recess 73 is also shown in FIG. 2.

If the cam plate 92 is pivoted in the direction of the arrow 97 by pressing the rocker-type switch 12 down, the free end 89*a* of the arm 89 moves into the end point 91*a* of the leg of the V-shaped cam, as a result of which the control shaft 89 rotates and the flap 82 assumes the operating position illustrated by dot-dashed lines in FIG. 13, in which position the transfer opening 45 is closed. A stem 106 (FIG. 21) is advantageously provided in the cover 60, with the flap 82 resting against the step 106 in its operating position, thereby defining the closed position. The closing movement of the flap 82 is coupled with the movement of the free end 88*a* of the control arm 88 into the leg end 90*a* of the U-shaped cam 90, as a result of which the control shaft 84 is pivoted and the transfer opening 47 is opened (FIGS. 11, 12). Similar to the recess 73, a recess 74 is provided in the upper portion 1 of the housing for accommodating the flap 81 in its rest position. Since the free end 87*a* of the control arm 84 in this situation moves only in the neutral region of the control cam 90, the control shaft 83 does not rotate.

If the rocker-type switch 12*a* is moved in the direction of the arrow 96, the free end 89*a* of the control arm 89 moves into the end point 91*b* of the leg and the flap 82 again closes the transfer opening 45, thereby blocking the wet intake channel. This control movement is coupled with the movement of the free end 87*a* of the control arm 87 into the leg end 90*b* of the control cam 90, as a result of which the control shaft 83 rotates, thereby opening the flow channel 10. To avoid any restriction of flow, the flap 80 is curved and rests flushly against a correspondingly curved portion of the wall of the brush chamber. The free end 88*a* of the control arm 88 remains in the neutral portion of the control cam 90, so that the transfer opening 47 stays closed.

The link member 95 is fixedly connected to a collar 98, and is preferably integrally formed with the collar. Disposed in the surface of the collar are arresting openings 99*a* to 99*c* that are engaged by a spring-loaded ball 100 that is held in the housing. When the ball 100 engages the arresting opening 99*b*, the mid-position of the rocker-type switch 12*a* is secured, with this mid-position corresponding to the position of the cam plate 92 shown in FIG. 14. In this position, an air/liquid mixture flows into the vacuum cleaning tool only through the wet intake opening 71, from where it is conveyed through the channel 70 past the brush chamber 7 and the flow channel 10 to the transfer opening 45, from where it enters the bypass channel 44 (see FIG. 10) of the turbine chamber housing. Since the bypass channel 44 bypasses the turbine chamber 43, the air/liquid mixture flows directly out through the connector 35.

When the ball 100 engages the arresting opening 99*a*, the flap 82 closes off the wet intake channel 70 while the transfer opening 47 is open, so that air flows to the turbine chamber 43 only via the auxiliary air openings 75 and the auxiliary air channel. This drives the air turbine 19 so that the brush roller 13 rotates. The vacuum cleaning tool can now be used for brushing. If the ball 100 engages the arresting opening 99*c*, the wet intake channel 70 is closed, the auxiliary air opening 47 is closed, and the flow channel 10 is now open, so that the brush roller 13 rotates in a normal manner and loosened or dissolved dirt enters the brush chamber 7 through the intake opening 53 and is carried off via the flow channel 10, the turbine chamber 43, and the connector 35.

The association of the opening of the flow channel 10 into the turbine chamber 43, the auxiliary air channel 47 into the turbine chamber, and the transfer of the wet intake channel 70 into the bypass channel 44, is ensured no matter what the pivoted position of the turbine chamber casing 30 about the axis of rotation 39 since the turbine chamber is open over a peripheral angle of 180°. One side of the air turbine 19 that is disposed in the turbine chamber 43 is connected to the drive shaft 21, which extends through the hollow shaft 20. The drive shaft 21 is mounted in the hollow shaft 20 and at its free end 22, which extends out of the hollow shaft 20, carries the drive belt pulley 18, which is preferably designed as a toothed belt pulley.

That end of the hollow shaft 20 that faces the air turbine 19 is provided with a bearing portion 23 that is rotatably held in the side wall 6*a* of the receiving means 6 (FIG. 1). The bearing portion 23 is provided with a mounting flange 24 that is designed to match the slot 32*a* in the side wall 32 of the turbine chamber casing 30. In a similar manner, a shaft is mounted in the side wall 6*a* of the receiving means 6 adjacent to the rocker-type switch 12*a* in such a way as to be rotatable about the central axis 39. A non-illustrated mounting flange of this shaft fits into the slot 32*a* on the other side of the turbine chamber casing 30. Opposite the mounting flange 24 and offset to the side is a screw flange 25 that, as illustrated by dot-dash lines in FIG. 10, is disposed across from the mounting means 45*a* and is intended for a securing bolt to fixedly connect the turbine chamber casing 30 to the upper portion 1 of the housing.

As indicated in FIG. 4, that end of the air turbine 19 that is remote from the drive shaft 21 is disposed adjacent to the partition 40 (FIG. 10). The air turbine 19 comprises a central disk 107, on both sides of which are provided vanes 77, 78 that extend at right angles to the disk 107. The rings of vanes are offset relative to one another in the direction of rotation and are closed off by axial cover disks 108, 109.

Figure 25:
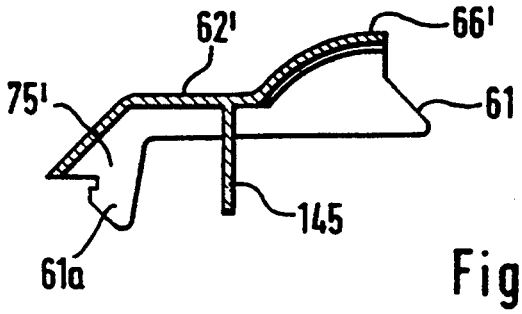
FIG. 25 is a cross-sectional view through the cover plate taken along the line XXV—XXV in FIG. 24.
Figure 24:
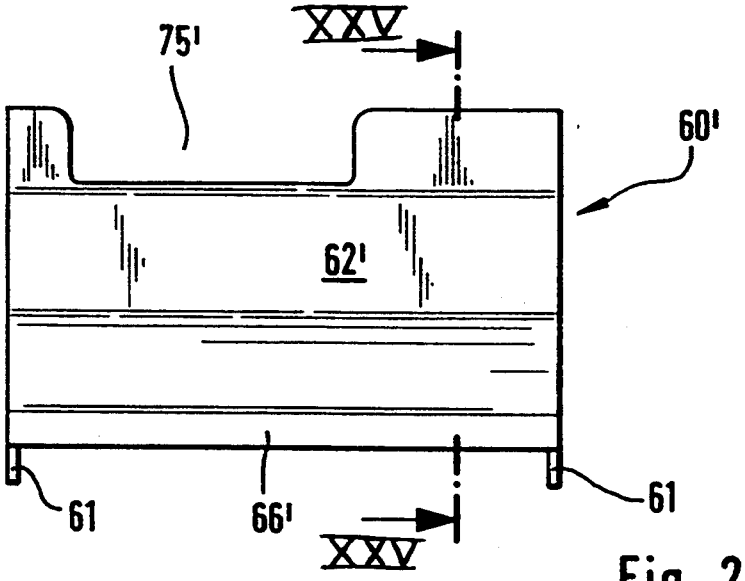
FIG. 24 is a top view of a cover plate.
Figure 26:
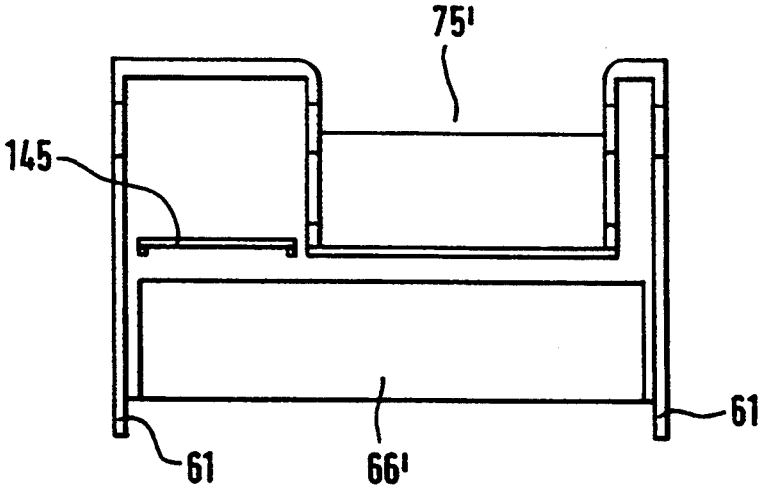
FIG. 26 is a view from below of the cover plate of FIG. 24.

As shown in FIGS. 24–26, in place of the cover 60, a cover plate 60' can be provided that essentially comprises a roof or top part 66' and an adjoining end portion 62'. As can be seen in particular from FIG. 25, a vertical end wall 145 is provided in the region of the transfer opening 45, thereby forming a closed space in the region of the transfer opening 45. The bypass channel 44 is thus closed off and no flow is possible through the bypass channel 44.

That end of the portion 62' remote from the top part 66' is provided with a cutout 75' via which auxiliary air can flow to the transfer opening 47. Thus, if the cover plate 60' is used, it is possible only to switch between the operating modes "brushing and vacuuming" and "brushing". If the vacuum cleaning tool is to be used predominantly for dry vacuuming, the cover 60 is replaced by the cover plate 60', so that the vacuum cleaning tool is physically smaller and is therefore more maneuverable.

The present invention is, of course, in no way restricted to the specific disclosure of the specification and drawings, but also encompasses any modifications within the scope of the appended claims.

What is claimed is:

1. A vacuum cleaning tool, comprising:

a housing having a base that is provided with at least one intake opening, said housing also having a connector means for connection to a vacuum line of a vacuum cleaning unit, wherein over and communicating with said at least one intake opening there is provided in said housing a brush chamber in which is disposed a brush roller having bristles that project out of said at least one intake opening, said housing furthermore having a flow channel that connects said brush chamber to said connector means, with a turbine chamber being disposed in said flow channel and accommodating an air turbine that is adapted to rotatably drive said brush roller, said tool also having a wet intake opening that is disposed approximately at a level of said base of said housing, and said tool additionally being provided parallel to said brush chamber and said flow channel, with a wet intake channel that connects said wet intake opening to said connector means;

respective controllable flow blocking means disposed in said wet intake channel and in said flow channel;

hood-like cover means disposed on said housing, said wet intake opening being formed by said cover means adjacent a front face of said housing approximately at a level of said at least one intake opening to said brush chamber, said cover means having a funnel portion that adjoins said wet intake opening and connects same to said wet intake channel; and means for fixedly securing said cover means to said housing.

2. A vacuum cleaning tool according to claim 1, wherein, parallel to said flow channel, said tool is provided with an auxiliary air channel that provides communication between outside air and said turbine chamber and that is provided with a further controllable flow blocking means.

3. A vacuum cleaning tool according to claim 2, wherein said flow blocking means have an operating position in which they close off a pertaining channel and a rest position in which they open a pertaining channel.

4. A vacuum cleaning tool according to claim 2, which includes a link member for connecting said flow blocking means in an interrelated manner.

5. A vacuum cleaning tool according to claim 4, wherein each of said flow blocking means is a flap that is fixedly connected to a control shaft that is pivotable about a respective axis of rotation.

6. A vacuum cleaning tool according to claim 5, wherein said link member is provided with control cam means for controlling positions of said flow blocking means, and wherein an end of each of said control shafts is provided with a respective control arm having a free end that engages said control cam means of said link member.

7. A vacuum cleaning tool according to claim 6, wherein said control arm of said control shaft for said flap of said flow channel, and said control arm of said control shaft for said flap of said auxiliary air channel, engage a common control cam means.

8. A vacuum cleaning tool according to claim 5, wherein said housing is provided with a common vertical slot for holding said control shafts of said flow blocking means one above the other.

9. A vacuum cleaning tool according to claim 4, wherein said turbine chamber is provided in a turbine chamber casing that is integral with said connector means and is mounted in said housing so as to be pivotable about an axis of rotation.

10. A vacuum cleaning tool according to claim 9, wherein said link member is also mounted in said housing so as to be pivotable about said axis of rotation.

11. A vacuum cleaning tool according to claim 10, wherein said link member is fixedly connected to a rocker-type switching means that is disposed in an upper portion of said housing.

12. A vacuum cleaning tool according to claim 9, wherein said air turbine has an axis of rotation that coincides with said axis of rotation of said turbine chamber casing.

13. A vacuum cleaning tool according to claim 4, which includes means for arresting said link member in respective operating and rest positions of said flow blocking means.

14. A vacuum cleaning tool according to claim 1, wherein said wet intake channel is formed between said cover means and an upper portion of said housing.

15. A vacuum cleaning tool according to claim 14, wherein said wet intake opening is formed by said cover means and an edge of said housing disposed at said level of said at least one intake opening, said wet intake opening preferably having the same width as said at least one intake opening.

16. A vacuum cleaning tool according to claim 1, which includes a turbine chamber casing that is disposed in said housing and is provided with a partition that divides said casing into said turbine chamber and a bypass channel that provides a bypass about said turbine chamber from said wet intake channel to said connector means.

17. A vacuum cleaning tool according to claim 1, wherein only one axial end of said air turbine is mounted in said housing.

* * * * *